US011199358B2

(12) United States Patent
Kim et al.

(10) Patent No.: US 11,199,358 B2
(45) Date of Patent: Dec. 14, 2021

(54) REFRIGERATOR AND METHOD FOR CONTROLLING THE SAME

(71) Applicant: LG ELECTRONICS INC., Seoul (KR)

(72) Inventors: Hyeryeong Kim, Seoul (KR); Jindong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 135 days.

(21) Appl. No.: 16/566,413

(22) Filed: Sep. 10, 2019

(65) Prior Publication Data

US 2020/0088461 A1 Mar. 19, 2020

(30) Foreign Application Priority Data

Sep. 14, 2018 (KR) ..... 10-2018-0110175

(51) Int. Cl.
*F25D 29/00* (2006.01)
*F25D 17/04* (2006.01)

(52) U.S. Cl.
CPC ..... *F25D 29/00* (2013.01); *F25D 17/045* (2013.01); *F25D 2700/123* (2013.01)

(58) Field of Classification Search
CPC .. F25D 17/045; F25D 17/06; F25D 2700/123; F25D 29/00; F25D 2500/04; F25D 2700/12
See application file for complete search history.

(56) References Cited

U.S. PATENT DOCUMENTS 5,850,969 A 12/1998 Hong et al.
6,216,478 B1 * 4/2001 Kang ..... F25D 29/00 62/228.4
6,591,622 B1 7/2003 Gherman et al.
7,908,875 B2 * 3/2011 Smith ..... F25B 49/005 62/129
7,975,497 B2 * 7/2011 Kaga ..... F25B 49/005 62/228.3
9,772,136 B2 * 9/2017 Shim ..... F25D 29/008
2014/0025207 A1 1/2014 Kanbara
2015/0143818 A1 * 5/2015 Eckhoff ..... F28D 15/04 62/3.2
2017/0219277 A1 * 8/2017 Ryu ..... F25B 49/025

FOREIGN PATENT DOCUMENTS

EP 2535672 A2 12/2012
KR 10-2009-0056516 A 6/2009

OTHER PUBLICATIONS

Search Report of European Patent Office in Appl'n No. 19196924.5, dated Feb. 18, 2020.

* cited by examiner

*Primary Examiner* — Filip Zec
(74) *Attorney, Agent, or Firm* — Dentons US LLP

(57) ABSTRACT

A method of controlling a refrigerator includes operating a cool air supply to output cool air for cooling a storage compartment, obtaining a result value based on a temperature value sensed by a temperature sensor during a first reference time interval, obtaining a plurality of result values during a second reference time interval, determining a representative temperature of the storage compartment among the obtained plurality of result values, determining an output of the cool air supply based on the representative temperature, and operating the cool air supply at the determined output.

17 Claims, 6 Drawing Sheets

FIG. 4

(a)

| NUMBER | 1 | 2 | 3 | 4 | ····· | M-2 | M-1 | M |
|---|---|---|---|---|---|---|---|---|
| AVERAGE VALUE | 4.1 | 4.2 | 4.0 | 4.1 | ····· | 4.2 | 4.3 | 4.1 |

(b)

| AVERAGE VALUE | FREQUENCY |
|---|---|
| 3.9 | 2 |
| 4.0 | 5 |
| 4.1 | 15 |
| 4.2 | 6 |
| 4.3 | 2 |
| 4.4 | 1 |

(c)

| AVERAGE VALUE | FREQUENCY |
|---|---|
| 3.9 | 1 |
| 4.0 | 4 |
| 4.1 | 10 |
| 4.2 | 10 |
| 4.3 | 5 |
| 4.4 | 1 |

(d)

| AVERAGE VALUE | FREQUENCY |
|---|---|
| 3.9 | 1 |
| 4.0 | 4 |
| 4.1 | 17 |
| 4.2 | 5 |
| 4.3 | 1 |

(e)

| AVERAGE VALUE | FREQUENCY |
|---|---|
| 3.9 | 0 |
| 4.0 | 0 |
| 4.1 | 1 |
| 4.2 | 0 |
| 4.3 | 0 |

REFRIGERATOR AND METHOD FOR CONTROLLING THE SAME

CROSS-REFERENCE TO RELATED APPLICATION

This application is based on and claims the benefit of priority to Korean Patent Application No. 10-2018-0110175, filed on Sep. 14, 2018, in the Korean Intellectual Property Office, the disclosure of which is incorporated herein in its entirety by reference.

BACKGROUND OF THE DISCLOSURE

Field of the Disclosure

The present disclosure relates to a refrigerator and a control method therefor.

Discussion of the Related Art

Refrigerators are home appliances that store food at a low temperature. A refrigerator includes a storage compartment that is constantly maintained at a low temperature.

In order to maintain a temperature of the storage compartment at a low temperature, the refrigerator uses a refrigerating cycle. The refrigerating cycle may include a compressor, a condenser, an expander, and an evaporator. The temperature of the storage compartment may be adjusted by controlling the compressor.

Korean patent application publication No. 10-2009-0056516 discloses a method for controlling a refrigerator that optimally controls a temperature inside the refrigerator by correcting an operating point temperature, which is a control element for controlling a refrigerating cycle.

The method for controlling the refrigerator includes detecting a temperature of a duct space of a storage compartment, detecting a temperature of a storage space of the storage compartment, and correcting the operating point temperature of a compressor based on the duct temperature and the detected temperature of the storage space.

The correcting of the operating point temperature of the compressor includes determining whether an average temperature of the storage space temperature detected at the on and off operating point of the compressor coincides with a preset reference temperature; and correcting the operating point temperature of the compressor when the average temperature and the preset reference temperature do not coincide with each other based on the determination result.

The operating point temperature of the compressor is corrected based on the temperatures detected by a plurality of temperature sensors.

However, even when the operating point temperature is corrected, when an error occurs in the temperature itself detected by each temperature sensor, the corrected operating point temperature may be unreliable.

SUMMARY OF THE DISCLOSURE

The present disclosure provides a refrigerator and a method for controlling the same that may precisely control a temperature of the storage compartment by obtaining a temperature value representative of an actual temperature of the actual storage compartment among temperature values detected by a temperature sensor for detecting the temperature of the storage compartment.

The present disclosure provides a refrigerator and a method for controlling the same that may obtain the temperature value representative of the actual temperature of the storage compartment among the temperature values through a control algorithm executed by a controller using existing temperature sensor.

In a first aspect of the present disclosure, there is provided a method of controlling a refrigerator including operating a cool air supply to output cool air for cooling a storage compartment, obtaining a result value based on a temperature value sensed by a temperature sensor during a first reference time interval, obtaining a plurality of result values during a second reference time interval, determining a representative temperature of the storage compartment among the obtained plurality of result values, determining an output of the cool air supply based on the representative temperature, and operating the cool air supply at the determined output.

In one implementation of the first aspect, the obtaining of the result value may include obtaining a plurality of temperature values at sampling time intervals during the first reference time interval, and obtaining the result value which is an average value of the plurality of temperature values.

In one implementation of the first aspect, the obtaining of the plurality of result values may include obtaining the result values at the first reference time intervals.

In one implementation of the first aspect, the determining of the representative temperature of the storage compartment may include obtaining a result value having a highest frequency among the plurality of result values, and determining the result value having the highest frequency as the representative temperature.

In one implementation of the first aspect, the determining of the representative temperature of the storage compartment may include obtaining a result value having a highest frequency among all of the plurality of result values.

In one implementation of the first aspect, the determining of the representative temperature of the storage compartment may include obtaining a result value having a highest frequency among some of the plurality of result values.

In one implementation of the first aspect, the determining of the representative temperature of the storage compartment may include determining a first result value initially obtained as a reference temperature, and obtaining a result value having a highest frequency among result values whose temperature difference from the reference temperature is within a certain range.

In one implementation of the first aspect, the determining of the representative temperature of the storage compartment may include when there are at least two result values having the highest frequency among all of the plurality of result values, determining one result value having a highest temperature of the at least two result values as the representative temperature.

In one implementation of the first aspect, the determining of the representative temperature of the storage compartment may include determining a result value initially obtained as a reference temperature, and when there is no result value whose temperature difference from the reference temperature is within a certain range among the plurality of result values, determining one of temperature values whose temperature difference from the reference temperature is within the certain range as the representative temperature.

In a second aspect of the present disclosure, there is provided a refrigerator including a cool air supply configured to cool a storage compartment, a temperature sensor configured to sense a temperature of the storage compartment, a memory configured to store a result value obtained using the temperature value sensed by the temperature sensor; and a controller configured to control the cool air supply.

In one implementation of the second aspect, the controller may be configured to determine a representative temperature of the storage compartment using the result value stored in the memory, and determine an output of the cool air supply based on the determined representative temperature to operate the cool air supply.

In one implementation of the second aspect, a plurality of temperature values may be obtained at sampling time intervals during a first reference time interval, and the controller may be configured to obtain an average value of the plurality of temperature values as the result value.

In one implementation of the second aspect, a plurality of result values may be obtained during a second reference time interval, and the controller may be configured to determine a result value having a highest frequency among the plurality of result values as the representative temperature.

BRIEF DESCRIPTION OF THE DRAWINGS

FIG. 4*a* is a table illustrating an average value of temperatures obtained at B time intervals.

FIGS. 4*b* to 4*e* are tables illustrating a frequency for each of average values obtained at B time intervals.

DETAILED DESCRIPTION OF PREFERRED EMBODIMENTS

Figure 1:
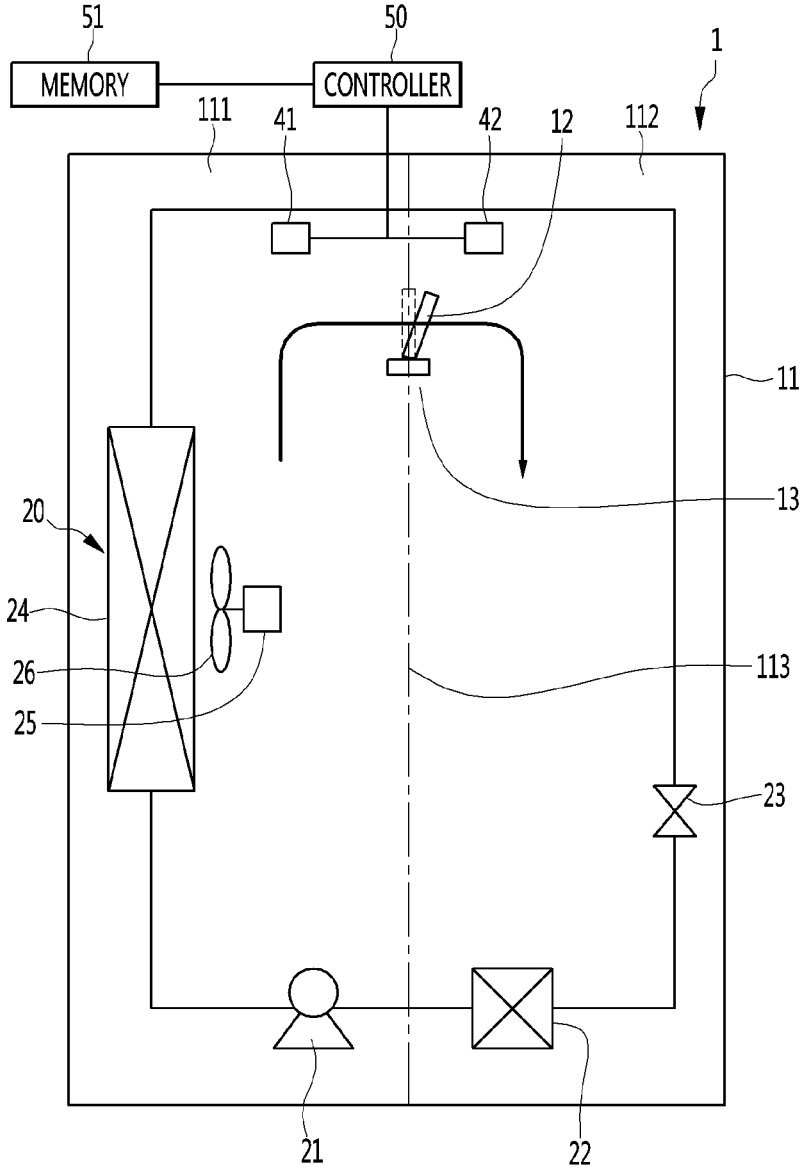
FIG. 1 is a diagram illustrating a configuration of a refrigerator according to an embodiment of the present invention.

Hereinafter, preferred embodiments of the present disclosure will be described in detail with reference to the accompanying drawings. It should be noted that when components in the drawings are designated by reference numerals, the same or similar components may have the same reference numerals even though the components are illustrated in different drawings. Further, in the description of the embodiments of the present disclosure, when it is determined that detailed descriptions of well-known configurations or functions may obscure the understanding of the embodiments of the present disclosure, the detailed descriptions of the well-known configurations or functions may be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a diagram illustrating a configuration of a refrigerator according to an embodiment of the present invention.

Referring to FIG. 1, a refrigerator 1 according to the embodiment of the present invention may include a cabinet 11 having a freezing compartment 111 and a refrigerating compartment 112 therein and a door (not shown) to open and close the freezing compartment 111 and a door (not shown) to open and close the refrigerating compartment 112.

The freezing compartment 111 and the refrigerating compartment 112 may store food and other objects.

The freezing compartment 111 and the refrigerating compartment 112 may be horizontally or vertically partitioned within the cabinet 10 by a partition wall 113. The partition wall 113 may include a cool air hole defined therein. Further, a damper 12 may be installed in the cool air hole to open or close the cool air hole.

The refrigerator 1 may further include a refrigerating cycle 20 for cooling the freezing compartment 111 and/or the refrigerating compartment 112.

The refrigerating cycle 20 may include a compressor 21 for compressing refrigerant, a condenser 22 for condensing refrigerant passing through the compressor 21, an expansion member 23 for expanding refrigerant passing through the condenser 22, and an evaporator 24 for evaporating refrigerant passing through the expansion member 23. The evaporator 24 may include a freezing compartment evaporator, for example.

The refrigerator 1 may include a fan 26 for enabling air to flow toward the evaporator 24 for circulation of cool air in the freezing compartment 111 and a fan motor 25 for driving the fan 26.

In the present embodiment, the compressor 21 and the fan motor 25 are operated in order to supply cool air to the freezing compartment 111, and not only are the compressor 21 and the fan motor 25 operated but also the damper 12 may be operated to open in order to supply cool air to the refrigerating compartment 112. The damper 12 may be operated by a damper motor 13.

The compressor 21, the fan motor 25 and the damper 12 (or the damper motor 13) may be referred to as a "cool air supply" which operate to supply the cool air to the storage compartment. The storage compartment may refer to the freezing compartment and/or the refrigerating compartment.

Adjusting an output of the cool air supply may be performed by adjusting an output of at least one of the compressor 21 and the fan motor 25, and/or adjusting an opening angle (a state of the damper) of the damper 12.

The refrigerator 1 may include a freezing compartment temperature sensor 41 for sensing a temperature of the freezing compartment 111, a refrigerating compartment temperature sensor 42 for sensing a temperature of the refrigerating compartment 112, a controller 50 for controlling the cool air supply based on the temperatures sensed by the temperature sensors 41 and 42, and a memory 51. The controller 50 may be a microprocessor, a digital signal processor, an integrated circuit, or an electrical logic circuit. The memory 51 may be a semiconductor memory.

The controller 50 may control one or more of the compressors 21 and the fan motor 25 in order to maintain the temperature of the freezing compartment 111 at a set temperature (or a target temperature).

In one example, the controller 50 may control the output of the compressor 21 while the fan motor 25 operates at a constant speed.

Alternatively, the controller 50 may control the output (rotational speed) of the fan motor 25 while the compressor 21 operates at a constant output.

The controller 50 may control the output of at least one of the compressor 21, the fan motor 25, and the damper motor 13 to maintain the temperature of the refrigerating compartment 112 at a set temperature.

In one example, the controller 50 may adjust the opening angle of the damper 12 while the compressor 21 and the fan motor 25 operate at the constant output.

The controller 50 may determine the output of the cool air supply by determining a preset constant value and/or a variable value based on a preset calculation method.

A set temperature range of the storage compartment may be a range between a first reference temperature lower than the set temperature and a second reference temperature higher than the set temperature. Controlling a temperature of the storage compartment to be maintained within the set temperature range may be referred to as a constant temperature control of the storage compartment.

A temperature between the first reference temperature and the second reference temperature may be referred to as a third reference temperature.

The third reference temperature may be a set temperature of the storage compartment or an average temperature of the first reference temperature and the second reference temperature, but is not limited thereto.

Figure 2:
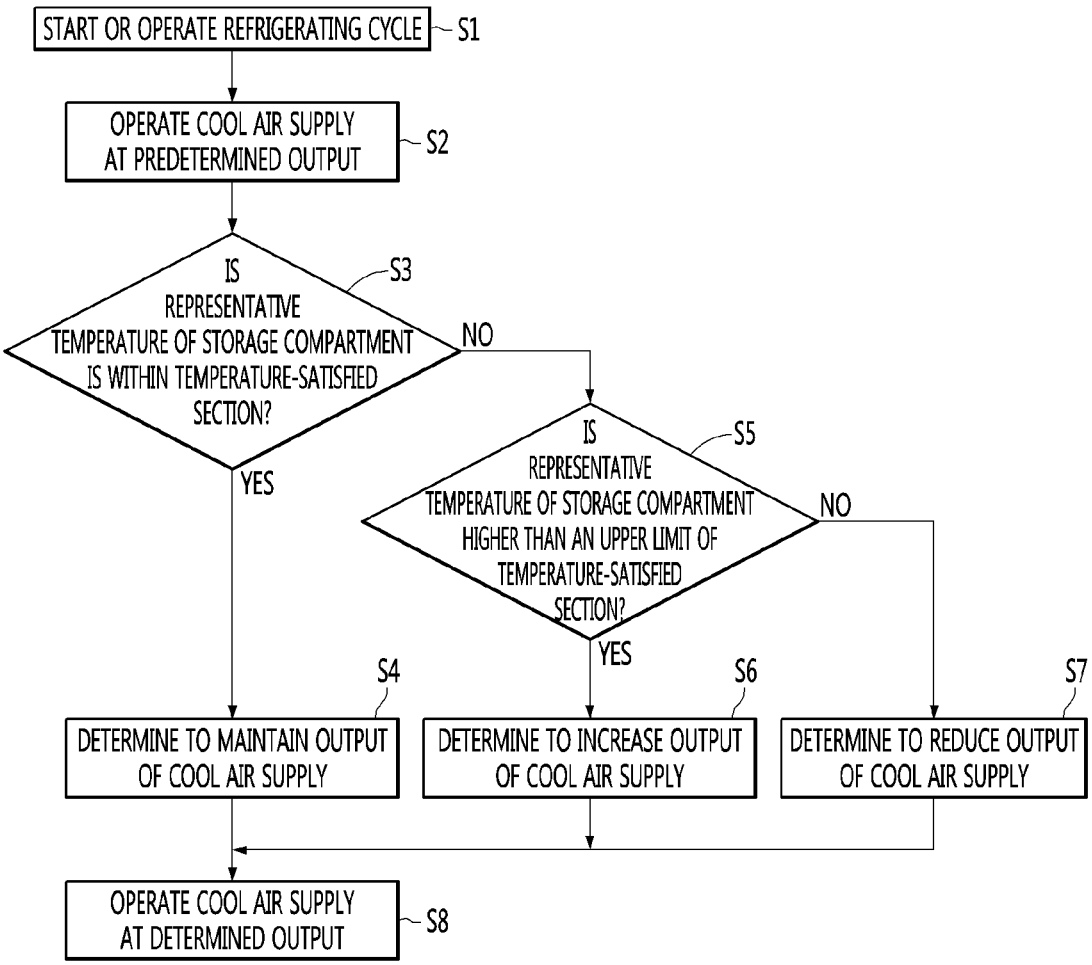
FIG. 2 is a flowchart illustrating a method of controlling a refrigerator according to an embodiment of the present invention.

FIG. 2 is a flowchart illustrating a method of controlling a refrigerator according to an embodiment of the present invention. For example, the flowchart may be illustrating a sequence of instructions executed by the microcontroller 50.

When the storage compartment is the freezing compartment, the cool air supply may include the compressor 21 and the fan motor 25. When the storage compartment is the refrigerating compartment, the cool air supply may include the compressor 21, the fan motor 25, and the damper motor 13.

Referring to FIGS. 1 and 2, in order to cool the storage compartment, the refrigerating cycle may be started (S1). Alternatively, the refrigerating cycle may already be in operation.

When the refrigerating cycle is started or operating, the cool air supply may operate to supply cool air at a predetermined output (S2).

When the temperature of the storage compartment is detected at sampling time intervals by the temperature sensors 41 and/or 42 during the operation of the cool air supply, the controller 50 may determine whether a representative temperature of the storage compartment is within a temperature-satisfied section (S3).

In the present embodiment, a lower limit temperature of the temperature-satisfied section may be set higher than the first reference temperature and an upper limit temperature thereof may be set lower than the second reference temperature. The set temperature of the storage compartment may be within the temperature-satisfied section.

As the determination result in S3, when the representative temperature of the storage compartment is in the temperature-satisfied section, the controller 50 may determine to maintain the output of the cool air supply (S4).

That is, during the operation of the refrigerating cycle, the cool air supply may operate at the same output as the output prior to the determination of the controller 50 in S3.

On the other hand, as the determination result in S3, when the representative temperature of the storage compartment is outside of the temperature-satisfied section, the controller 50 may determine whether the representative temperature of the storage compartment is higher than the upper limit temperature of the temperature-satisfied section (S5).

As the determination result in S5, when the representative temperature of the storage compartment is higher than the upper limit temperature of the temperature-satisfied section, the controller 50 may determine to increase the output of the cool air supply (S6).

An amount of increase in cooling power of the cool air supply may be determined differently based on a magnitude of a difference between the representative temperature of the storage compartment and the upper limit temperature of the temperature-satisfied section.

For example, when the difference between the upper limit temperature of the temperature-satisfied section and the representative temperature is less than 0 and an absolute value of the difference between the upper limit temperature of the temperature-satisfied section and the representative temperature is less than or equal to a first reference value, the controller 50 may determine to increase the output of the cool air supply means by a first level.

Further, when the difference between the upper limit temperature of the temperature-satisfied section and the representative temperature is less than 0 and the absolute value of the difference between the upper limit temperature of the temperature-satisfied section and the representative temperature is larger than the first reference value, the controller 50 may determine to increase the output of the cool air supply means by a second level. The second level is greater than the first level.

On the other hand, as the determination result in S5, when the representative temperature of the storage compartment is not higher than the upper limit temperature of the temperature-satisfied section, it may be a case in which the representative temperature of the storage compartment is lower than the lower limit temperature of the temperature-satisfied section.

As such, when the representative temperature of the storage compartment is lower than the lower limit temperature of the temperature-satisfied section, the controller 50 may determine to reduce the cooling power of the cool air supply (S7).

An amount of cooling power reduction may be determined differently based on a magnitude of a difference between the representative temperature of the storage compartment and the lower limit temperature of the temperature-satisfied section.

For example, when the difference between the lower limit temperature of the temperature-satisfied section and the representative temperature is larger than 0 and an absolute value of the difference between the lower limit temperature of the temperature-satisfied section and the representative temperature is equal to or lower than the first reference value, the controller 50 may determine to decrease the output of the cool air supply by the first level.

Further, when the difference between the lower limit temperature of the temperature-satisfied section and the representative temperature is larger than 0 and the absolute value of the difference between the lower limit temperature of the temperature-satisfied section and the representative temperature is larger than the first reference value, the controller 50 may determine to decrease the output of the cool air supply by the second level.

The controller 50 operates the cool air supply at the determined cooling power (S8).

Hereinafter, a process of obtaining the representative temperature of the storage compartment will be described.

Figure 3:
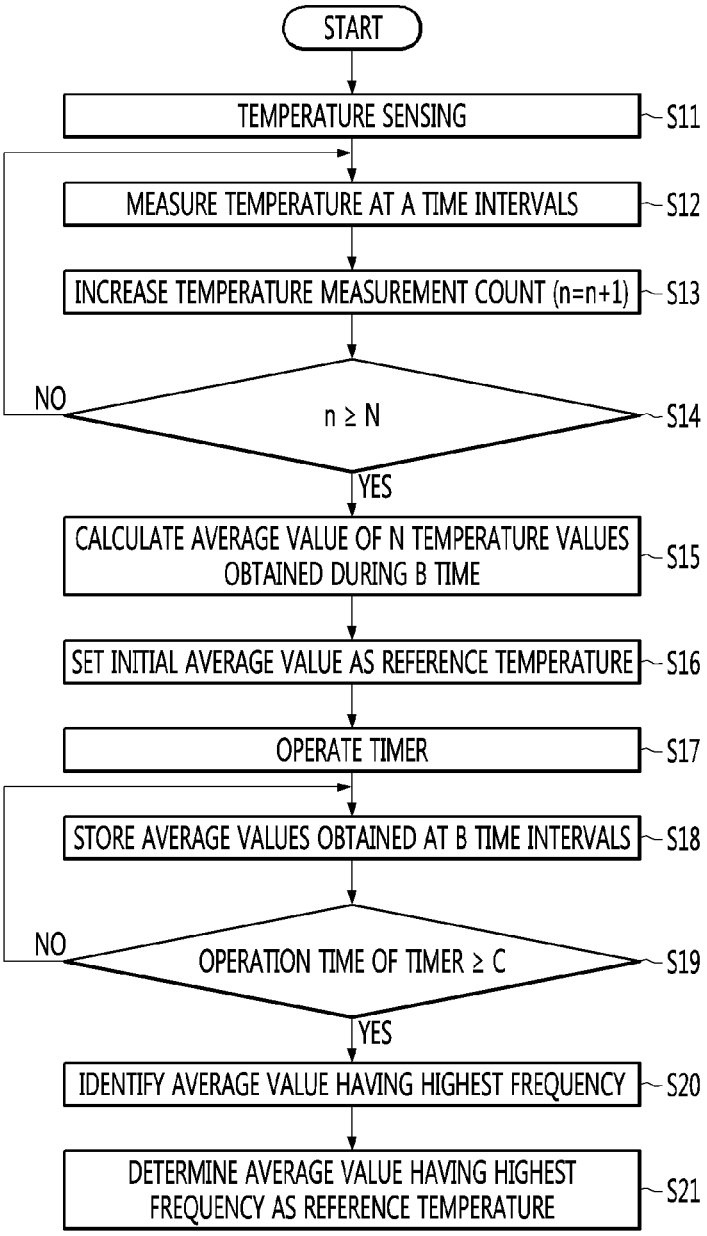
FIG. 3 is a flowchart illustrating a process of obtaining a representative temperature of a storage compartment according to an embodiment of the present invention.

FIG. 3 is a flowchart illustrating a process of obtaining a representative temperature of a storage compartment according to an embodiment of the present invention.

FIG. 4*a* is a table illustrating an average value of temperatures obtained at B time intervals.

FIGS. 4*b* to 4*e* are tables illustrating a frequency for each of average values obtained at B time intervals.

Referring to FIGS. 1 and 3, when the refrigerating cycle is started or is operating, temperature is sensed by the temperature sensors 41 and/or 42.

The temperature sensors 41 and/or 42 may measure temperature at A time intervals (which may be referred to as sampling time intervals) (S12).

The temperature sensors 41 and/or 42 may output a value of a ratio of a sensor voltage and a reference voltage as a sensor output value. Such a sensor output value is AD (analog to digital) converted and transmitted to the controller 50, and the controller 50 uses the transmitted value.

However, a dispersion may occur in the sensor output values measured and outputted by the temperature sensors 41 and/or 42. When such sensor output values are AD converted, the dispersion also exists in the converted values.

When the output of the cool air supply is controlled based on the sensor output values in which the dispersion exists, a precise control of the temperature of the storage compartment may be difficult. When it is difficult to precisely control the temperature of the storage compartment, a variation in the temperature of the storage compartment may become large.

In the present embodiment, the sensor output values measured and outputted by the temperature sensors 41 and/or 42 are AD converted. The converted values are not immediately used and a value representative of a current temperature of the storage compartment is determined as the representative temperature. Then, the representative temperature is used to control the output of the cool air supply. An example of this process is described below.

In the present embodiment, the A time interval may be 2 ms, but is not limited thereto.

The sensor output values obtained at the A time intervals may be AD converted and then stored in the memory 51. Hereinafter, the AD converted value will be referred to as a temperature value.

The controller 50 counts the number of temperature values (n) obtained at A time intervals (S13). The controller 50 may determine whether the number of counted temperature values (n) is N (S14).

Although not limited, the number N may be sixteen.

The controller 50 calculates an average value (which may be referred to as a result value) of the N temperature values obtained during the B time (the first reference time) (S15). In one example, the B time may be 32 ms.

An average value initially obtained is set as a reference temperature (S16). The reference temperature may be a temperature used to set the representative temperature of the storage compartment.

A timer may be operated (S17). The timer may be used to determine the number of average values obtained.

While the timer is operated, the average values are obtained at the B time intervals in the same manner as in S12 to S15 (S18). The obtained average values may be stored in the memory 51.

The controller 50 may determine whether an operation time of the timer has reached C time (which is a second reference time) (S19).

As the determination result in S19, when the operation time of the timer is determined to have reached the C time, the controller 50 may identify the representative value of the storage compartment using information of a plurality of (M) average values obtained during the C time, and determine the representative value as the representative temperature.

Alternatively, without using the timer, when the number of average values obtained at the B time intervals reaches M, the controller 50 may identify the representative value using information of the plurality of average values and determine the representative value as the representative temperature of the storage compartment.

Referring to FIG. 4*a*, in one example, the plurality of M average values may be stored in the memory 51.

As shown in the table of FIG. 4*a*, since an average value initially obtained is 4.1 degree, the 4.1 degree may be set as the reference temperature. Although not limited, the average value may be divided in units of 0.1 degrees.

Referring to FIG. 4*b*, the frequency of the average values obtained may be stored in the memory 51.

The controller 50 may calculate the frequency of the obtained average values based on the plurality of M average values stored in the memory 51.

From the calculated frequencies of the plurality of M average values, the controller 50 may identify an average value having a highest frequency among the average values (S20).

In the present embodiment, since the average value of the highest frequency among the plurality of M average values may be substantially close to the temperature of the storage compartment, the average value having the highest frequency is determined as the representative value, and the representative value is determined as the representative temperature of the storage compartment.

In the present embodiment, it is assumed that the number M of average values obtained during the C time is 31, but is not limited thereto.

FIG. 4*b* illustrates an example where an average value with the highest frequency among the total 31 average values stored in the memory 51 is 4.1 degree. Here, 4.1 degree may be determined as the representative temperature.

FIG. 4*c* illustrates another example where the controller 50 has calculated a different set of frequencies for 31 average values stored in the memory 51. Here, the same number of frequencies for multiple average values may exist among the obtained 31 average values. For instance, 10 4.1 degree may be calculated and 10 4.2 degree may be calculated.

In this case, a higher value among average values having the same number of frequency may be set as the representative value. This is because the temperature of the storage compartment needs to be lowered when the temperature of the storage compartment is high.

In another example, some of the M average values obtained may be stored in the memory 51 or used for counting the frequency such that a calculation of the controller 50 or a storage capacity in the memory may be reduced.

As described above, since the initial average value is set as the reference temperature, only an average value whose temperature difference from the reference temperature is within a certain range may be stored in the memory or used for the frequency counting.

For example, as shown in FIG. 4*d*, an average value within a range of ±0.2 degrees relative to the reference temperature may be used for the frequency counting. That is, five distinct average values may be used for the frequency counting, but it should be noted that the number distinguished in the present embodiment is not limited thereto.

Then, values other than 3.9 degree, 4.0 degree, 4.2 degree, and 4.3 degree, including 4.1 degree, are not used for the counting.

FIG. 4*d* illustrates a case in which 28 average values among 31 average values are used for the frequency counting, as an example.

In one example, when a dispersion of the values outputted by the temperature sensors 41 and/or 42 is large, there may be a case in which the average value within the range of ±0.2 degrees relative to the reference temperature may not exist as shown in FIG. 4*e*.

Even in this case, the output of the cool air supply should be controlled by determining the representative temperature of the storage compartment. In the present embodiment, when the average value within the range of ±0.2 degrees relative to the reference temperature does not exist, a maximum value among the average values used for the frequency counting may be determined as the representative value.

For example, when the reference temperature is determined to be 4.1 degree, the maximum value of 4.3 degree may be determined as the representative value.

According to the present embodiment, a refrigerator and a method for controlling the same that may precisely control the temperature of the storage compartment despite the dispersion of the temperature sensor by determining the temperature value representative of an actual temperature of the storage compartment among the temperature values detected by the temperature sensor are provided.

In addition, since the representative temperature of the storage compartment may be obtained through a control algorithm using existing temperature sensor, no structural change or additional cost may be required.

Figure 5:
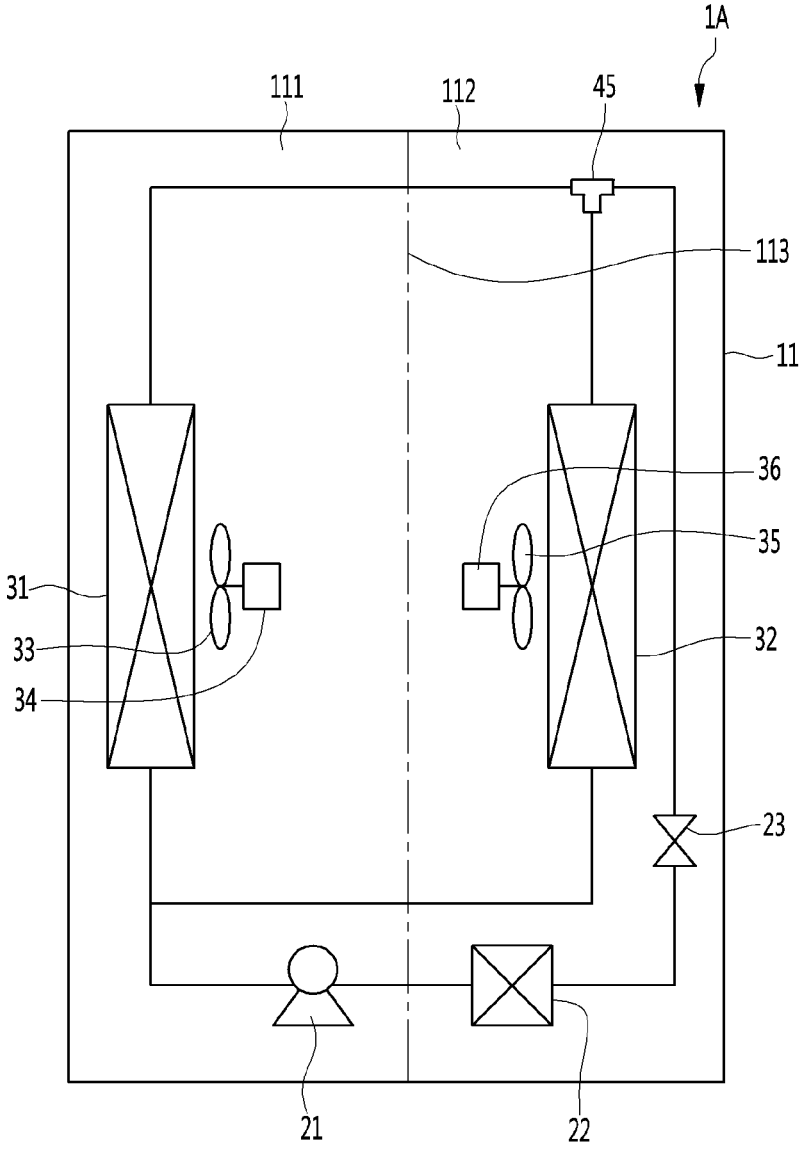
FIG. 5 is a diagram illustrating a refrigerator according to another embodiment of the present invention.

FIG. 5 is a diagram illustrating a refrigerator according to another embodiment of the present invention.

Referring to FIG. 5, unlike the refrigerator of the previous embodiment, a refrigerator 1A of the present embodiment may include an evaporator 31 for a freezing compartment 111 and an evaporator 32 for a refrigerating compartment 112.

The refrigerator 1A may include a fan 33 and a first fan motor 34 for a freezing compartment 111, and a fan 35 and a second fan motor 36 for a refrigerating compartment 112.

The refrigerator 1A includes a compressor 21, a condenser 22, an expansion member 23, and a valve 45 for allowing a refrigerant passed through the expansion member 23 to flow into one of the evaporator 31 for the freezing compartment 111 and the evaporator 32 for the refrigerating compartment 112.

In the present embodiment, constant temperature control of the freezing compartment 111 may be performed by control of the compressor 21 and the first fan motor 34 which may constitute the cool air supply. Further, constant temperature control of the refrigerating compartment 112 may be performed by control of the compressor 21 and the second fan motor 36 which may constitute the cool air supply. In addition, the constant temperature control of the refrigerating compartment 112 may also be performed by control of an opening angle of the valve 45 which may constitute the cool air supply.

In the present embodiment, representative temperatures of the freezing compartment 111 and the refrigerating compartment 112 may be used to perform the constant temperature control of the freezing compartment 111 and the refrigerating compartment 112. The representative temperatures may be obtained by using the method described in FIGS. 2, 3, and 4*a*-4*e* in the same or similar manner.

In the present embodiment, a freezing cycle may be operated to cool the freezing compartment 111, and a refrigerating cycle may be operated to cool the refrigerating compartment 112.

The "the refrigerating cycle is operated" may refer to the compressor 21 is turned on, the fan 35 for the refrigerating compartment is rotated, and, while the refrigerant flows in the evaporator 32 for the refrigerating compartment by the valve 45, the refrigerant flowing in the evaporator 32 for the refrigerating compartment is heat-exchanged with air.

Further, "the freezing cycle is operated" may refer to the compressor 21 is turned on, the fan 33 for the freezing compartment is rotated, and, while the refrigerant flows in the evaporator 31 for the freezing compartment by the valve 45, the refrigerant flowing in the evaporator 31 for the freezing compartment is heat-exchanged with air.

During the operation of each cycle, the output of the cool air supply may be controlled based on the representative temperature of the storage compartment.

Figure 6:
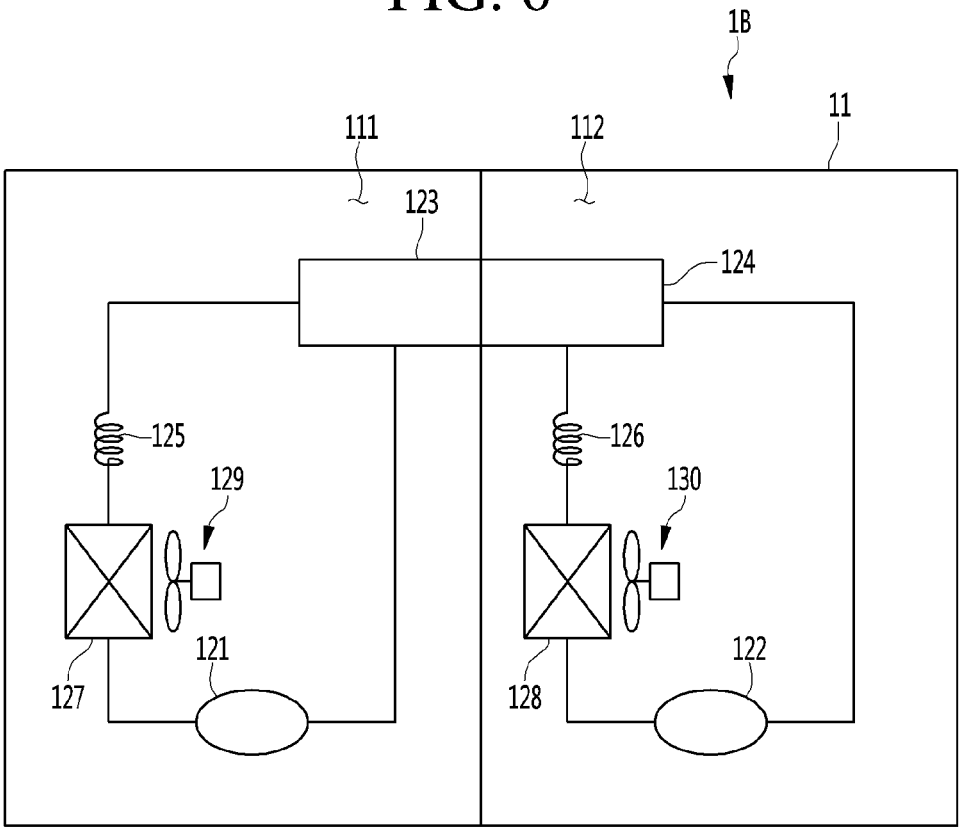
FIG. 6 is a diagram illustrating a refrigerator according to another embodiment of the present invention.

FIG. 6 is a diagram illustrating a refrigerator according to another embodiment of the present invention.

Referring to FIG. 6, unlike the refrigerators of the previous embodiments, a refrigerator 1B of present embodiment may include a cabinet 11 having a freezing compartment 111 and a refrigerating compartment 112 therein, an evaporator 127 for a freezing compartment 111, an evaporator 128 for a refrigerating compartment 112, a compressor 121 for a freezing compartment 111, a compressor 122 for a refrigerating compartment 112, condensers 123 and 124, an expansion member 125 for a freezing compartment 111, an expansion member 126 for a refrigerating compartment 112, a fan motor assembly 129 for a freezing compartment 111, and a fan motor assembly 130 for a refrigerating compartment 112.

In the present embodiment, the freezing compartment 111 and the refrigerating compartment 112 may be independently cooled by separate compressors and evaporators.

However, the condensers 123 and 124 constituting one heat exchanger may be divided into two parts to allow the refrigerant to flow. That is, the refrigerant discharged from the compressor 121 for the freezing compartment 111 may flow through a first portion (here, first condenser 123) of the condensers 123 and 124 constituting one heat exchanger. Further, the refrigerant discharged from the compressor 122 for the refrigerating compartment 112 may flow through a second portion (here, second condenser 124) of the condensers 123 and 124 constituting one heat exchanger.

In the present embodiment, the freezing compartment 111 and the refrigerating compartment 112 may be independently cooled.

In the present embodiment, constant temperature control of the freezing compartment 111 may be performed by control of the compressor 121 for the freezing compartment 111 and of the fan motor assembly 129 for the freezing compartment 111, which may constitute the cool air supply. Further, constant temperature control of the refrigerating compartment 112 may be performed by control of the compressor 122 for the refrigerating compartment 112 and the fan motor assembly 130 for the refrigerating compartment 112, which may constitute the cool air supply.

In the present embodiment, representative temperatures of the freezing compartment 111 and the refrigerating compartment 112 may be used to perform the constant temperature control of the temperature of the freezing compartment 111 and the refrigerating compartment 112. The representative temperatures may be obtained by using the method described in FIGS. 2, 3, and 4*a*-4*e* in the same or similar manner.

What is claimed is:

1. A method of controlling temperature by a refrigerator including a controller, the method comprising:

operating a cool air supply to output cool air for cooling a storage compartment;

obtaining a result value based on a temperature value sensed by a temperature sensor during a first reference time interval, wherein the obtaining of the result value includes:

obtaining a plurality of temperature values sensed by the temperature sensor by sampling during the first reference time interval; and obtaining the result value which is an average value of the plurality of temperature values;

obtaining a plurality of average values during a second reference time interval, wherein the obtaining of the plurality of average values includes:

obtaining the plurality of average values at respective first reference time intervals during the second reference time interval;

determining a representative temperature of the storage compartment among the obtained plurality of average values;

determining an output of the cool air supply based on the representative temperature; and operating the cool air supply at the determined output.

2. The method of claim 1, wherein the determining of the representative temperature of the storage compartment includes:

obtaining the average value having a highest frequency among the plurality of average values; and determining the average value having the highest frequency as the representative temperature.

3. The method of claim 2, wherein the determining of the representative temperature of the storage compartment includes:

obtaining the average value having the highest frequency among all of the plurality of average values.

4. The method of claim 2, wherein the determining of the representative temperature of the storage compartment includes:

obtaining the average value having the highest frequency among some of the plurality of average values.

5. The method of claim 4, wherein the determining of the representative temperature of the storage compartment includes:

determining a first average value initially obtained as a reference temperature; and obtaining the average value having the highest frequency among the plurality of average values whose temperature difference from the reference temperature is within a predetermined range.

6. The method of claim 2, wherein the determining of the representative temperature of the storage compartment includes:

when there are at least two average values having same highest frequency among all of the plurality of average values, obtaining one average value of the at least two average values as the representative temperature.

7. The method of claim 6, wherein the obtained one average value is an average value having a higher temperature among the at least two average values.

8. The method of claim 2, wherein the determining of the representative temperature of the storage compartment includes:

determining an average value initially obtained as a reference temperature; and when there is no average value whose temperature difference from the reference temperature is within a predetermined range among the plurality of average values, obtaining one of average values whose temperature difference from the reference temperature is within the predetermined range as the representative temperature.

9. The method of claim 8, wherein the obtained one of the average values as the representative temperature is a highest temperature value among the average values whose temperature difference from the reference temperature is within the predetermined range.

10. A refrigerator comprising:

a storage compartment;

a cool air supply to cool the storage compartment;

a temperature sensor to sense a temperature value of the storage compartment, wherein the temperature sensor senses a plurality of temperature values at sampling time intervals during a first reference time interval;

a memory to store a result value obtained based on the temperature value sensed by the temperature sensor; and a controller to control the cool air supply, wherein the controller is configured to obtain an average value of the plurality of temperature values as the result value, and configured to obtain a plurality of average values during a second reference time interval, wherein the controller is configured to:

determine a representative temperature of the storage compartment using the plurality of average values stored in the memory; and determine an output of the cool air supply based on the determined representative temperature.

11. The refrigerator of claim 10, wherein the controller is configured to determine the average value having a highest frequency among the plurality of average values as the representative temperature.

12. The refrigerator of claim 11, wherein the controller is configured to obtain the plurality of average values at respective first reference time intervals during the second reference time interval.

13. The refrigerator of claim 11, wherein the controller is configured to determine the average value having the highest frequency among all of the plurality of average values as the representative temperature of the storage compartment.

14. The refrigerator of claim 11, wherein the controller is configured to determine the average value having the highest frequency among some of the plurality of average values as the representative temperature of the storage compartment.

15. The refrigerator of claim 14, wherein the controller is configured to determine an initially obtained average value as a reference temperature, and wherein the controller is configured to determine the average value having the highest frequency among average values whose temperature difference from the reference temperature is within a predetermined range as the representative temperature of the storage compartment.

16. The refrigerator of claim 11, wherein when there are at least two average values having same highest frequency among all of the plurality of average values, the controller is configured to determine one of the at least two average values having a higher temperature as the representative temperature of the storage compartment.

17. The refrigerator of claim 11, wherein the controller is configured to determine an initially obtained average value as a reference temperature; and wherein when there is no average value whose temperature difference from the reference temperature is within a predetermined range among the plurality of average values, the controller is configured to determine a highest temperature value among temperature values whose temperature difference from the reference temperature is within the predetermined range as the representative temperature.

* * * * *